United States Patent [19]

Cohen

[11] Patent Number: 4,652,385

[45] Date of Patent: Mar. 24, 1987

[54] LUBRICATING OIL COMPOSITIONS CONTAINING NOVEL COMBINATION OF STABILIZERS

[75] Inventor: Stephen C. Cohen, Thornhill, Canada

[73] Assignee: Petro-Canada Inc., Toronto, Canada

[21] Appl. No.: 756,628

[22] Filed: Jul. 19, 1985

[51] Int. Cl.[4] ..... C10M 135/00; C10M 137/02

[52] U.S. Cl. ..... 252/48.6; 252/498

[58] Field of Search ..... 252/49.8, 32.5, 78.5, 252/48.6

[56] References Cited

U.S. PATENT DOCUMENTS

| | | | |
|---|---|---|---|
| 3,115,463 | 12/1963 | Orloff et al. | 252/49.8 |
| 3,115,464 | 12/1963 | Orloff et al. | 252/49.8 |
| 3,115,465 | 12/1963 | Orloff et al. | 252/78.5 |
| 3,556,999 | 1/1971 | Messina et al. | 252/78 |
| 3,652,411 | 3/1972 | Commichau | 252/34.7 |
| 4,374,219 | 3/1983 | Spivack et al. | 524/91 |
| 4,612,131 | 9/1986 | Rosenberger | 252/48.6 |

FOREIGN PATENT DOCUMENTS

| | | | |
|---|---|---|---|
| 1185962 | 4/1985 | Canada | 253/127 |

*Primary Examiner*—William R. Dixon, Jr.
*Assistant Examiner*—Ellen M. McAvoy
*Attorney, Agent, or Firm*—Rogers, Bereskin & Parr

[57] ABSTRACT

Lubricant compositions are disclosed in which a synergistic combination of low-volatility tri-substituted phosphite and low-volatility sterically hindered phenolic stabilizers provide surprisingly effective antioxidant qualities to lubricating oils selected from hydrotreated oils, poly-alpha-olefin oils and paraffinic white oils, and mixtures thereof.

14 Claims, No Drawings

LUBRICATING OIL COMPOSITIONS CONTAINING NOVEL COMBINATION OF STABILIZERS

The present invention relates to novel lubricating oil compositions, and particularly to lubricating oil compositions containing a novel stabilizer/antioxidant system comprising high molecular weight phosphites and hindered phenols.

In most applications of lubricating oils which are to be used at elevated temperatures, it is desirable that the lubricating oil formulation exhibit good oxidation resistance, in order to minimize or prevent the formation of sludge increase in viscosity and acidity of the lubricant, and the consequent lowering of the lubricating ability of the oil and lubricating system in general.

In the prior art, many materials have been disclosed to improve high-temperature oxygen stability and resistance to discoloration, including calcium naphtha sulphonates, barium versatates, calcium phenates, and various phenols, phosphates and phosphites. However, conventional systems have shown limited success when used with certain primarily paraffinic lubricating oils, and hence there is a need for a reliable stabilizing system for use with these oils.

Phosphites are known in the art as stabilizers for lubricating oils. In U.S. Pat. No. 3,652,411, Commichau disclosed a mixture of phosphite, phenol, substituted amine, organic phosphate, polyhydroxyquinone and benzotriazole as a stabilizer for polyglycol lubricant. There was no discussion of subcombinations of this rather complex mixture. Orloff et al. in U.S. Pat. No. 3,115,463 disclosed the stabilization of mineral oils and synthetic diester oils by a synergistic mixture of dialkyl hydrogen phosphite and substituted phenol or bisphenol. U.S. Pat. No. 3,115,464 by the same inventors disclosed an orthoalkyl phenol in admixture with dialkyl hydrogen phosphite, where the alkyl groups were isopropyl or tertiary butyl. Spivack et al. in U.S. Pat. No. 4,374,219 were disclosed a phosphite stabilizer which was an alkanolamine ester of a noncyclic and a cyclic phosphite. It was said to be useful as a stabilizer for lubricating oils and polymers, alone or in combination with selected hindered phenols, including some of the hindered phenols of the present invention. However, hydrotreated oils present particular problems for stabilizers in hot oxygen or air exposure of lubricating oils, as acknowledged in Canadian Pat. No. 1185962 of Bijwaard et al. That patent disclosed a hydrotreated oil having poor oxidation stability to which was added a substantial quantity of less severely hydrotreated oil containing some remaining sulphur. Nevertheless, there remains a need for a really effective stabilizer for use with hydrotreated oils, poly-alpha-olefins and paraffinic white oils.

Accordingly, the invention provides a lubricating composition comprising a major amount of lubricating oil selected from the group consisting of hydrotreated oil, poly-alpha-olefin oil and paraffinic white oil, and an antioxidant amount of a synergistic mixture of:

(a) a low-volatility organically substituted phosphite or diphosphite, wherein the substituent groups are alkyl, aryl or alkylaryl, and said phosphite contains substantially no hydroxy groups, and (b) a low-volatility sterically hindered phenolic compound.

Lubricating compositions according to the invention exhibit superior oxidation resistance as measured by, for example, an IP-48 test carried out for 24 hours at 200° C. In this test, the sample is subjected to relatively severe oxidation conditions by heating to 200° C. and passing air through it at 15 liters per hour. For the purposes of the present disclosure the oxidation was carried out for four six-hour periods instead of the normal two periods, such that the sample was subjected to oxidation for 24 hours in total. The change in viscosity and in Total Acid Number of the sample are the properties of primary interest and are reported herein. At the same time, the compositions according to the invention exhibit no significant discoloration after 24 hours in the modified IP-48 test. It is also advantageous in many applications that the lubricants of the invention exhibit high clarity throughout their operating life for several reasons, including the reason that a clear lubricant can be seen by eye not to contain significant amounts of suspended solids; because suspended solids can be abrasive in use, it is useful that their absence can be detected visually.

The hindered phenol of the invention comprises compounds having alkyl groups at the ortho positions on the ring with respect to the hydroxyl group. The presence of these inhibiting alkyl groups slows the sacrificial oxidation of the phenol to increase its effectiveness as an antioxidant in the lubricating oil. The phenol compounds are preferably selected from compounds having the formula (i)

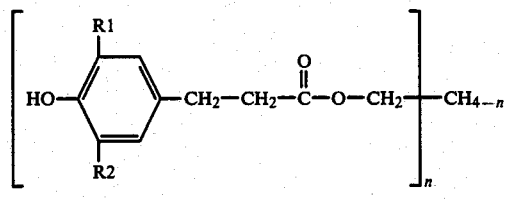

wherein R1 and R2 are selected from the group isopropyl and tertiary butyl, and n is 2, 3 or 4, and compounds having the formula (ii)

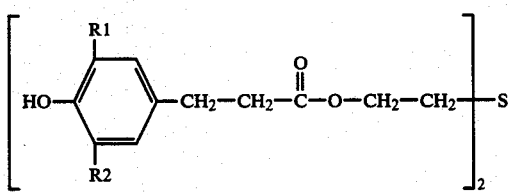

where R1 and R2 are independently isopropyl or tertiary butyl. For good performance at high temperatures of the lubricating compositions of this invention, it is critical that the volatility of the stabilizing antioxidants be low at elevated temperatures. In this specification, low volatility denotes a material that in a thermogravimetric analysis, loses no more than 5 percent of its mass below 180° C., when heated in air at a rate of 10° C. to 20° C./min, and further that the rate of weight loss is low up to 250° C. so that preferably the 50 percent loss temperature is above 300° C. This characteristic is especially suitable in lubricating compositions for use in heat transfer oils and compressor oils which are generally subjected to high temperatures (180° C.–300° C.) service. Such low volatility is required of both the phenol and the phosphite antioxidants in the synergistic combination of the invention. Preferred phenolic antioxidants in the invention are: Tetrakis(methylene-3,5-ditert-butyl 4 hydroxy-hydrocinnamate)methane or thio-diethylene bis(3,5-di-tert-butyl-4-hydroxy-hydrocinnamate)methane.

The phosphite in the compositions of the invention is preferably selected from aromatic phosphites of the following formulae:

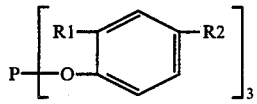

(i)

where R1 and R2 are, independently, alkyl groups having from thre to six carbon atoms, and

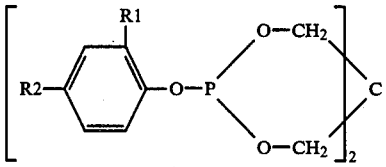

(ii)

where R1 and R2 are, independently, alkyl groups having from three to six carbon atoms. The phosphites in the compositions of the invention must be hydrolytically stable, as measured by the ASTM D2619 test. In this test the lubricating oil final composition including the stabilizing mixture is maintained in contact with water at 93° C. in the presence of a copper coupon for 48 hours. The weight loss of the coupon is measured, together with the acidity of the water layer and other properties. The test measures the propensity of the additives to be hydrolysed in the presence of water, heat and active metals. In this test, a hydrolytically stable lubricating oil composition should produce an increase in acidity in the water layer of no more than 1 mg KOH and Total Acid Number change in the oil layer of no more than 0.1; and the weight loss of the copper coupon should not exceed 0.1 mg/cm$^2$. The successful phosphites that are within the scope of the invention are tri-substituted, that is, having all three of the hydrogen atoms replaced by organic substituent groups. Preferred phosphites in the compositions of the invention are: tris(2,4-di-tert-butylphenyl)phosphite; and bis-(2,4-di-tert-butylphenyl pentaerythritol)diphosphite.

The stabilizers of the invention are used in antioxidant amounts in the lubricating compositions. Generally the total weight of stabilizers is from 0.05 percent to 2 percent, and preferably from 0.1 percent to 1 percent, of the lubricating oil. The mixture of phenol and phosphite has been found to have synergistic effect throughout the range of mixture ratios. The weight ratio of phenol:-phosphite is preferably from 1:6 to 1:2 where the phosphite stabilizer comprises a phosphite of formula (i) having one phosphorus atom per molecule, and from 1:5 to 1:1 where the phosphite stabilizer is of formula (ii) having two phosphorus atoms per molecule.

The compositions of the invention are made from lubricating oil selected from the group consisting of poly-alpha-olefin oils, paraffinic white oils and in particular, hydrotreated oils. The latter oils are made from vacuum gas oil fractions which have been subjected to a two-stage high-hydrogen-pressure hydrotreating process in the presence of active zeolite catalysts. Aspects of such process are disclosed in U.S. Pat. Nos. 3,493,493, 3,562,149, 3,761,388, 3,763,033, 3,764,518, 3,803,027, 3,941,680 and 4,285,804. In the first stage of a typical hydrotreatment process, the hydrogen pressure is in the vicinity of 20 MPa and the temperature is maintained at about 390° C., using a fluorided Ni-W catalyst on a silica-alumina support; nitrogen-, sulphur- and oxygen-containing compounds are almost entirely removed from the feedstock; and other effects include a high degree of saturation of aromatics and a high degree of ring scission of the polycyclic intermediates. Lubricating oil fractions from the first stage are dewaxed and subjected to further hydrogen treatment in the presence of a catalyst, for example, Ni-W on a silica-alumina support, at lower temperature than the first stage. Aromatics and olefins are further saturated in this stage. The product oil contains substantially no sulphur or nitrogen, and only trace amounts of aromatics, being substantially entirely composed of saturates including paraffins and cycloparaffins.

Examples of typical oils are shown in Table 1. Hydrotreated oils are available from several manufactures, two of which are included in the Table as representative of the type. The near total absence of aromatics, unsaturates, sulphur and nitrogen characterizes the hydrotreated oils.

TABLE 1

| | Typical Composition of Lubricating Oils | | | |
|---|---|---|---|---|
| | Hydrotreated (Gulf Canada) | Hydrotreated (Chevron Corp.) | Solvent Refined Paraffinic | Naphthenic Basestock |
| Viscosity Grade (SUV at 38.4° C.) | 160 | 100 | 160 | 100 |
| Total Saturates, percent | 99.97 | 99.74 | 84.14 | 58.22 |
| Paraffins (iso + normal) | 32.60 | 35.60 | 17.74 | 12.22 |
| Cycloparaffins (total) | 67.37 | 64.14 | 66.40 | 46.00 |
| Monocyclo | (30.81) | (32.04) | (24.46) | (15.69) |
| Dicyclo | (19.52) | (17.96) | (15.24) | (12.82) |
| Tricyclo | (8.87) | (7.81) | (9.10) | (8.21) |
| Tetracyclo | (4.75) | (4.15) | (10.58) | (6.01) |
| Pentacycle | (2.56) | (1.80) | (4.67) | (2.45) |
| Hexacyclo | (0.86) | (0.34) | (2.35) | (0.82) |
| Total Aromatics, percent | 0.03 | 0.26 | 14.37 | 31.06 |
| Monoaromatics | (0.03) | (0.17) | (10.49) | (12.28) |
| Diaromatics | Nil | (0.06) | (2.60) | (12.58) |
| Triaromatics | Nil | (0.03) | (0.48) | (2.72) |
| Tetra aromatics | Nil | Nil | (0.13) | (2.28) |
| Penta aromatics | Nil | Nil | (0.67) | (1.20) |
| Thiophenes (Total), percent | Nil | Nil | 0.19 | 9.09 |
| Total Polar Compounds, percent | Nil | Nil | 1.30 | 1.64 |

TABLE 1-continued

| | Typical Composition of Lubricating Oils | | | |
|---|---|---|---|---|
| | Hydrotreated (Gulf Canada) | Hydrotreated (Chevron Corp.) | Solvent Refined Paraffinic | Naphthenic Basestock |
| S, ppm | 2 | 53 | 500 | 13,400 |
| N, ppm | 1 | 5 | 30 | 160 |

Poly-alpha-olefin oils are manufactured by oligomerizing olefins, for example n-decene, which are then saturated to remove the remaining double bond. These materials by their nature contain no sulphur, nitrogen, oxygen or aromatics.

Paraffinic white oils are made from conventional napthenic or solvent-refined lubricating oils by contact with concentrated sulphuric acid to remove aromatics, sulphur and nitrogen compounds. In recent years the acid treatment has been supplemented by first subjecting the feedstocks to a mild hydrogen treatment. All three types of lubricating oils are similar in that they contain substantially no aromatics or unsaturated compounds and substantially no heteroatoms. It is not clear whether the synergistic effect of the hindered phenol and phosphite antioxidants of the invention occur because of the substantially saturated nature of the lubricating oils to be protected, or because of the absence of heteroatoms. What is known, as will be illustrated hereinafter, is that the same combinations of antioxidants in naphthenic and solvent-refined lubricating oils are not synergistic in their protection against oxidation.

In addition, the lubricating compositions of the invention can include other additives as necessary for the specific application in which the lubricating oils are to be used, for example, rust inhibitors, defoamers, demulsifiers, extreme pressure additives, viscosity index improvers and pour point depressants. All of these materials are well known in the art of formulating lubricating oils, and the person skilled in the art will be aware of the need to select thermally stable additives suitable to the end-use application of the particular lubrication product.

By way of example, typical lubricant products including lubricating compositions according to the invention include the following. All amounts of ingredients are shown as percentages by weight and the remainder is hydrotreated, paraffinic white, or poly-alpha-olefin lubricating oil to make up 100 percent of the formulation.

| | |
|---|---|
| 1. Hydraulic Oil | |
| Tetrakis-(methylene-3,5 di-tert-butyl-4-hydroxy-hydrocinnamate)methane | 0.2% |
| Tris-(2, 4-di-tert-butylphenyl) phosphite | 0.04% |
| Rust inhibitor | 0.1% |
| Demulsifier | 25 ppm |
| Defoamer | 200 ppm |
| Pour point depressant | 0.2% |
| Copper corrosion inhibitor | 0.03% |
| 2. Steam Turbine Oil | |
| Tetrakis-(methylene-3,5 di-tert-butyl-4-hydroxy-hydrocinnamate)methane | 0.2% |
| Tris-(2,4-di-tert-phenyl)phosphite | 0.2% |
| Rust inhibitor-alkylsuccinate | 0.1% |

-continued

| | |
|---|---|
| Demulsifier | 25 ppm |
| Defoamer | 200 ppm |
| Pour point depressant | 0.2% |
| Copper corrosion inhibitor | 0.03% |
| 3. Compressor Oil | |
| Thio-diethylene bis-(3,5-di-tert-butyl-4 hydroxy hydrocinnamte) | 0.2% |
| Tris-(2,4-di-tert-phenyl)phosphite | 0.2% |
| Rust inhibitor-alkylsuccinate | 0.05% |
| Demulsifier | 25 ppm |
| Defoamer | 200 ppm |
| Pour point depressant | 0.2% |
| Detergent or dispersant | 0.3% |
| Antiwear Additive | 0.5% |
| 4. Heat Transfer Oil | |
| Tetrakis-(methylene-3,5 di-tert-butyl-4-hydroxy-hydrocinnamate)methane | 0.1% |
| Tris-(2,4-di-tert-phenyl)phosphite | 0.4% |
| Rust Inhibitor | 0.05% |
| Detergent or Dispersant | 0.1% |

The compositions of the invention are made by normal blending and mixing techniques, generally at room temperature or slightly elevated temperature to aid in dissolution of the ingredients. Any of the generally-used types of blending apparatus can be employed, including fixed in-line blenders and batch stirrers.

EXAMPLE 1

Several lubricating oil compositions exemplifying the invention were made by simple mixing of a hindered phenol, namely tetrakis-(methylene-3,5-di-tert-butyl-4-hydroxy-hydrocinnamate)methane, a phosphite, namely tris-(2,4-di-tert-butyl-phenyl)phosphite, and hydrotreated lubricating oil of ISO 32 grade manufactured by Gulf Canada, in the proportions shown in Table 2. The results of an extended IP-48 oxidation stability test on each mixture are shown also in the table, and illustrate the synergistic action of the antioxidant mixture.

EXAMPLE 2

The two antioxidants of Example 1 were mixed in varying proportions with a second sample of ISO 32 hydrotreated oil, this sample made by Chevron Corporation, in the amounts shown in Table 3. The extended IP-48 oxidation stability test results confirm the synergistic action of the mixture of antioxidants in this type of hydrotreated oil.

EXAMPLE 3

The same antioxidants as in Examples 1 and 2 were mixed with a poly-alpha-olefin synthetic oil, and tested as in Examples 1 and 2. The synergism with the poly-alpha-olefin oil was confirmed.

TABLE 2

| | Example 1 | | | | | | | | |
|---|---|---|---|---|---|---|---|---|---|
| | Run Number | | | | | | | | |
| | 1 | 2 | 3 | 4 | 5 | 6 | 7 | 8 | 9 |
| Composition | | | | | | | | | |

TABLE 2-continued

| | Example 1 | | | | | | | | |
|---|---|---|---|---|---|---|---|---|---|
| | Run Number | | | | | | | | |
| | 1 | 2 | 3 | 4 | 5 | 6 | 7 | 8 | 9 |
| Tetrakis-(methylene-3,5-di-tert-butyl-4-hydroxy-hydrocinnamate) methane | 0.00% | 0.07% | 0.10% | 0.17% | 0.25% | 0.33% | 0.40% | 0.43% | 0.50% |
| Tris-(2,4-di-tert-butyl-phenyl) phosphite | 0.50 | 0.43 | 0.40 | 0.33 | 0.25 | 0.17 | 0.10 | 0.07 | 0.00 |
| ISO 32 hydrotreated lubricating oil (Gulf Canada) | 99.50 | 99.50 | 99.50 | 99.50 | 99.50 | 99.50 | 99.50 | 99.50 | 99.50 |
| Oxidation Stability (24 hours, IP-48) | | | | | | | | | |
| Viscosity increase at 40° C., percent | 912 | 4.7 | 4.5 | 5.2 | 69 | 377 | 498 | 560 | 712 |
| Total Acid Number increase | 15.3 | 0.02 | 0.01 | 0.01 | 4.03 | 10.9 | 12.5 | 12.5 | 14.2 |

TABLE 3

| | Example 2 | | | | | |
|---|---|---|---|---|---|---|
| | Run Number | | | | | |
| | 10 | 11 | 12 | 13 | 14 | 15 |
| Composition | | | | | | |
| Tetrakis-(methylene-3,5-di-tert-butyl-4-hydroxy-hydrocinnamate) methane | 0.00% | 0.10% | 0.17% | 0.25% | 0.40% | 0.50% |
| Tris-(2,4-di-tert-butyl-phenyl)phosphite | 0.50 | 0.40 | 0.33 | 0.25 | 0.10 | 0.00 |
| ISO 32 lubricating oil (Chevron) | 99.50 | 99.50 | 99.50 | 99.50 | 99.50 | 99.50 |
| Oxidation Stability (24 hours, IP-48) | | | | | | |
| Viscosity increase at 40° C., percent | 438 | 8.7 | 9.4 | 87 | 184 | 357 |
| Total Acid Number increase | 12.2 | 0.01 | 0.06 | 5.3 | 8.4 | 11.5 |

TABLE 4

| | Example 3 | | | | | |
|---|---|---|---|---|---|---|
| | Run Number | | | | | |
| | 16 | 17 | 18 | 19 | 20 | 21 |
| Composition | | | | | | |
| Tetrakis-(methylene-3,5-di-tert-butyl-4-hydroxy-hydrocinnamate)methane | 0.00% | 0.10% | 0.17% | 0.25% | 0.43% | 0.50% |
| Tris-(2,4-di-tert-butyl-phenyl) phosphite | 0.50 | 0.40 | 0.33 | 0.25 | 0.07 | 0.00 |
| ISO 32 Poly-alpha Olefin Oil | 99.50 | 99.50 | 99.50 | 99.50 | 99.50 | 99.50 |
| Oxidation Stability (24 hours, IP-48) | | | | | | |
| Viscosity increase at 40° C., percent | 375 | 3 | 15 | 59 | 215 | 210 |
| Total Acid Number increase | 11.6 | 0.01 | 1.0 | 4.0 | 5.5 | 10.0 |

TABLE 5

| | Example 4 | | | | | |
|---|---|---|---|---|---|---|
| | Run Number | | | | | |
| | 22 | 23 | 24 | 25 | 26 | 27 |
| Composition | | | | | | |
| Tetrakis-(methylene-3,5-di-tert-butyl-4-hydroxy-hydrocinnamate)methane | 0.00% | 0.10% | 0.17% | 0.25% | 0.40% | 0.50% |
| Bis-(2,4-di-tert-butyl phenyl) pentaerythritol diphosphite | 0.50 | 0.40 | 0.33 | 0.25 | 0.10 | 0.00 |
| ISO 32 Hydrotreated Oil (Gulf Canada) | 99.50 | 99.50 | 99.50 | 99.50 | 99.50 | 99.50 |
| Oxidation Stability (24 hours, IP-48 | | | | | | |
| Viscosity increase at 40° C., percent | 452 | 8.1 | 8.7 | 8.6 | 213 | 712 |
| Total Acid Number increase | 10.6 | 0.05 | 0.03 | 0.03 | 8.8 | 14.2 |

TABLE 6

| | Example 5 | | | |
|---|---|---|---|---|
| | Run Number | | | |
| | 28 | 29 | 30 | 31 |
| Composition | | | | |
| Thio diethylene bis-(3,5-di-tert-butyl-4-hydroxy-hydro-cinnamate) | 0.0% | 0.2% | 0.27% | 0.4% |
| Tris-(2,4-di-tert-butyl-phenyl)phosphite | 0.4 | 0.2 | 0.13 | 0.0 |
| Rust Inhibitor | 0.5 | 0.5 | 0.5 | 0.5 |

TABLE 6-continued

| | Example 5 | | | |
|---|---|---|---|---|
| | Run Number | | | |
| | 28 | 29 | 30 | 31 |
| ISO 32 Hydrotreated Oil (Gulf Canada) | 99.1 | 99.1 | 99.1 | 99.1 |
| Oxidation Stability (24 hours, IP-48) | | | | |
| Viscosity increase at 40° C., percent | 757 | 57.4 | 22.7 | 130 |
| Total Acid Number increase | 13.7 | 0.8 | 0.8 | 8.0 |

TABLE 7

| | Solvent-Refined Oil | | | | | |
|---|---|---|---|---|---|---|
| | Run Number | | | | | |
| | 32 | 33 | 34 | 35 | 36 | 37 |
| Compositon | | | | | | |
| Tetrakis-(methylene-3,5-di-tert-butyl-4-hydroxy-hydrocinnamate)methane | 0.00% | 0.07% | 0.10% | 0.17% | 0.25% | 0.50% |
| Tris-(2,4-di-tert-butyl-phenyl)phosphite | 0.50 | 0.43 | 0.40 | 0.33 | 0.25 | 0.00 |
| ISO 32 Solvent-Refined Oil | 99.50 | 99.50 | 99.50 | 99.50 | 99.50 | 99.50 |
| Oxidation Stability (24 hours, IP-48) | | | | | | |
| Viscosity increase at 40° C., percent | 100 | 87 | 99 | 90 | 95 | 106 |
| Total Acid Number increase | 4.8 | 4.3 | 5.3 | 5.0 | 4.7 | 5.0 |

EXAMPLE 4

Several lubricating oil compositions were made in the same manner as Example 1 using the same oil and phenol stabilizer, and using bis-(2,4-di-tert-butyl phenyl)-pentaerythritol disphosphite as the phosphite stabilizer. The oxidation stability results confirm the synergism of the second type of phosphite in compositions according to the invention.

EXAMPLE 5

The phosphite stabilizer and lubricating oil of Example 1 were mixed with a different hindered phenol, thio diethylene bis-(3,5-di-tert-butyl-4-hydroxy-hydrocinnamate) in varying proportions and with a rust inhibitor in the amount of 0.5 percent. This phenol is also shown to exhibit synergism with the phosphite, by the oxidation stability results in Table 6.

By way of contrast to the specific oils included in the invention, the antioxidants of Example 1 were used in compositions in which the oil was a solvent-refined oil. The mixtures of antioxidant produced no significant improvement in the oxidation stability, as illustrated in Table 7. The solvent-refined oil contained 14.4 percent aromatics, 0.2 percent thiophenes and 1.3 percent polar compounds including 500 ppm of sulphur and 25 ppm of nitrogen.

It will be seen that lubricant compositions according to the invention are advantageous for use in applications where the lubricant is exposed to an oxidizing environment and high temperatures, for example compressor oils, heat transfer oils, hydraulic fluids and steam turbine oils.

What is claimed is:

1. A lubricating composition comprising a major amount of lubricating oil selected from the group consisting of hydrotreated oil, poly-alpha-olefin oil and paraffinic white oil, and an antioxidant amount of a synergistic mixture of (a) a low-volatility, hydrolytically stable, organically substituted phosphite or diphosphite, wherein the substituent groups are alkyl, aryl or alkylaryl, and said phosphite contains substantially no hydroxy groups, and (b) a low-volatility sterically hindered phenolic antioxidant, wherein, low volatility denotes a material which in a thermogravimetric analysis, by heating in air at a rate between 10° and 20° C./min, loses no more than 5 percent of its mass below 180° C., and has a 50 percent mass loss temperature above 300° C., and wherein hydrolytically stable is as measured by an ASTM D2619 test.

2. A lubricating composition as claimed in claim 1, wherein said phosphite is selected from the group having the formulas:

(i)

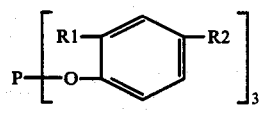

wherein R1 and R2 are, independently, alkyl groups having from 3 to 6 carbon atoms, and (ii)

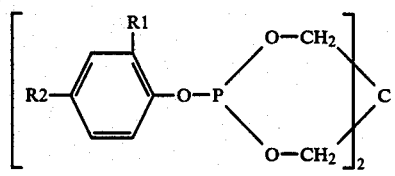

wherein R1 and R2 are, independently, alkyl groups having from 3 to 6 carbon atoms.

3. A lubricating composition as claimed in claim 1 or 2, wherein said phenol is selected from the group having the formulas:

(i)

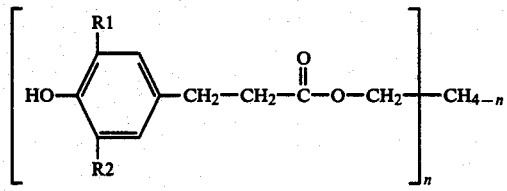

where R1 and R2 are, independently, isopryopyl or tertiary butyl, and n is 2, 3 or 4, and (ii)

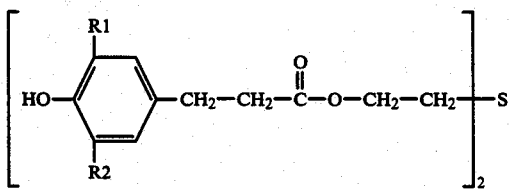

where R1 and R2 are, independently, isopropyl or tertiary butyl.

4. A lubricating composition as claimed in claim 3 wherein said phenol is of formula (i) and R1 and R2 are tertiary butyl groups.

5. A lubricating composition as claimed in claim 3 wherein said phenol is of formula (ii) and R1 and R2 are tertiary butyl groups.

6. A lubricating oil as claimed in claim 2 wherein said phosphite is of formula (i) and the ratio of phenol to phosphite is from about 1:6 to 1:2 by weight.

7. A lubricating composition as claimed in claim 2 wherein said phosphite is of the formula (ii) and the ratio of phenol to phosphite is from about 1:5 to 1:1 by weight.

8. A lubricating composition as claimed in claims 1, 6 or 7 wherein the total amount of said stabilizers is from about 0.1 percent to 1 percent of said lubricating composition.

9. A lubricating composition as claimed in claim 2 wherein said phosphite is of the formula (i) and R1 and R2 are tertiary butyl.

10. A lubricating composition as claimed in claim 2 wherein said phosphite is of the formula (ii) and R1 and R2 are tertiary butyl.

11. A lubricating composition as claimed in 1, 2 or 3, wherein said lubricating oil comprises hydrotreated oil.

12. A lubricating composition as claimed in claim 1 wherein said lubricating oil comprises poly-alpha olefin.

13. A lubricating composition as claimed in claim 1 wherein said lubricating oil comprises paraffinic white oil.

14. A lubricating composition as claimed in claim 11, wherein the hydrotreated oil is a vacuum gas oil fraction which has been subjected to a two-stage high-hydrogen pressure hydrotreating process in the presence of active zeolite catalysts, and is characterized by near total absence of aromatics, unsaturates, sulphur and nitrogen.

* * * * *